US005534817A

United States Patent [19]

Suzuki et al.

[11] Patent Number: 5,534,817

[45] Date of Patent: Jul. 9, 1996

[54] VOLTAGE GENERATING CIRCUIT

[75] Inventors: Tomohiro Suzuki, Tsukuba, Japan; Toshiyuki Sakuta, Plano, Tex.

[73] Assignees: Texas Instruments Incorporated, Dallas, Tex.; Hitachi Ltd., Tokyo, Japan

[21] Appl. No.: 292,538

[22] Filed: Aug. 18, 1994

[30] Foreign Application Priority Data

Aug. 18, 1993 [JP] Japan ..... 5-225094

[51] Int. Cl.[6] ..... G05F 3/02

[52] U.S. Cl. ..... 327/545; 327/543; 327/546; 327/541

[58] Field of Search ..... 327/538, 540, 327/541, 543, 545, 546

[56] References Cited

U.S. PATENT DOCUMENTS

| | | | |
|---|---|---|---|
| 4,788,455 | 11/1988 | Mori et al. | 327/538 |
| 4,812,735 | 3/1989 | Sawada et al. | 327/543 |
| 4,893,091 | 1/1990 | Lillis et al. | 330/253 |
| 5,264,743 | 11/1993 | Nakagome et al. | 327/546 |
| 5,362,988 | 11/1994 | Hellums | 327/543 |

*Primary Examiner*—Terry Cunningham

*Attorney, Agent, or Firm*—David S. Guttman; Richard L. Donaldson

[57] ABSTRACT

A voltage generating circuit for providing a prescribed voltage, such as $\frac{1}{2}V_{DD}$ of the power source voltage $V_{DD}$, wherein the capacity of the current and the response time of the voltage generating circuit is significantly improved. When the output voltage $V_{OUT}$ of the voltage generating circuit drops suddenly from a reference value $\frac{1}{2}V_{DD}$ and goes below the lower limit of an allowable voltage level VM–, an n-type MOS transistor MN5A of an output voltage detecting circuit 14 turns on. The potential of the gate terminal for a p-type MOS transistor MP6A in a digital output circuit 16 is pulled to the level of the output voltage $V_{OUT}$ via the transistor MN5A that was turned on, and said p-type MOS transistor MP6A is turned on in the saturated area more or less perfectly. By virtue of a large amount of current flowing to the output side of a terminal side, namely the load circuit side, at an appropriate voltage from a power source terminal 18 via p-type MOS transistor MP6A which was turned on in the saturated area, a reduction in output voltage $V_{OUT}$ is stopped quickly and the output voltage is restored to the normal level within a short time.

1 Claim, 2 Drawing Sheets

VOLTAGE GENERATING CIRCUIT

This invention relates to a voltage generating circuit which feeds a prescribed voltage with respect to a capacitive load circuit. In particular it relates to a $\frac{1}{2}V_{DD}$ generating circuit which feeds approximately ½ of the voltage ($\frac{1}{2}V_{DD}$) of the power source voltage ($V_{DD}$).

BACKGROUND OF THE INVENTION

Generally, the technology of taking half (½) of voltage $\frac{1}{2}V_{DD}$ of power source voltage $V_{DD}$ for the potential of the memory cell plate and the precharge potential of the bit line is used in a dynamic RAM (DRAM).

The $\frac{1}{2}V_{DD}$ precharge method precharges the bit line pair (bit line/auxiliary bit line) to $\frac{1}{2}V_{DD}$ beforehand, amplifies the slight change in the potential of the bit line or the bit auxiliary line connected to the memory via a sense amplifier according to the memory information of the target memory cell during the reading, pulls up one of the bit lines to "1" ($V_{DD}$) and pulls down the other to "0" ($V_{SS}$) according to the direction of the change (contents of the memory information), and there are the advantages that the time for pulling up or pulling down of the bit pair is shorter compared to the $V_{SS}$ precharge method and the $V_{DD}$ precharge method, and that sensing can be executed at high speed. Furthermore, when the bit line pair divided into the complementary voltages ($V_{DD}$, $V_{SS}$) are short circuited, both are automatically balanced to the middle level (½ level), so that there exists the advantage of being able to return to the precharge voltage easily. Also, according to the method of setting the potential of the memory cell plate to $\frac{1}{2}V_{DD}$, it is possible to control or relax the electric field applied to the insulation film to $\pm\frac{1}{2}V_{DD}$ whether the stored voltage of the memory cell is "1" ($V_{DD}$) or "0" ($V_{SS}$).

However, when the read operation of the data from the memory cell or the data write operation in the memory cell is insufficient, the potential of the bit line or the auxiliary bit line may become lower than $V_{DD}$. When this happens, even if the bit line pair is short circuited in the $\frac{1}{2}V_{DD}$ precharge method and the potential of both are balanced to the middle level, it does not return precisely to the precharge voltage ($\frac{1}{2}V_{DD}$). Also, the memory cell plate voltage may fluctuate due to the noise, etc., within the memory circuit, and there is the risk that the data will become destroyed because it is maintained unstably with fluctuating memory cell plate voltage.

Therefore, conventionally, a $\frac{1}{2}V_{DD}$ generating circuit which constantly outputs $\frac{1}{2}V_{DD}$ has been provided, and the stabilized output voltage $\frac{1}{2}V_{DD}$ was fed directly or indirectly (via a gate) to the bit line pair or the memory cell plate in this type of memory in order to handle fluctuations in the cell plate voltage, and the defects in the data reading operation from the memory cell or data writing operation to the memory cell, etc.

In FIG. 5 a circuit configuration of a conventional $\frac{1}{2}V_{DD}$ generating circuit is shown. This $\frac{1}{2}V_{DD}$ generating circuit comprises a reference voltage generating circuit 100 which includes four MOS transistors M1–M4 and an output circuit 102 composed of a pair of MOS transistors M5–M6.

In reference voltage generating circuit 100, the source terminal of p-type MOS transistor M1 is connected to power source voltage terminal 104 which provides power source voltage $V_{DD}$, and the source terminal of n-type MOS transistor M4 is connected to ground terminal 106 which provides ground potential $V_{SS}$. The gate terminal and drain terminal of n-type MOS transistor M2 are connected to the drain terminal of p-type MOS transistor M1, and the drain terminal and the gate terminal of p-type MOS transistor M3 are connected to the drain terminal of n-type MOS transistor M4. The gate terminal of p-type MOS transistor M1, the gate terminal of n-type MOS transistor M4, the source terminal of n-type MOS transistor M2, and the source terminal of p-type MOS transistor M3 are connected.

In output circuit 102, the drain terminal of n-type MOS transistor M5 is connected to power source voltage terminal 104, and the drain terminal of p-type MOS transistor M6 is connected to ground terminal 106. The source terminal of N-type MOS transistor M5 and the source terminal of P-type MOS transistor M6 are connected, and are also connected to output terminal 108. The gate terminal of n-type MOS transistor M5 is connected to the gate terminal of n-type MOS transistor M2 and the source terminal of p-type MOS transistor M1. The gate terminal of p-type MOS transistor M6 is connected to the gate terminal of p-type MOS transistor M3 and the drain terminal of n-type MOS transistor M4. n-type MOS transistor M5 has the same constitution as n-type MOS transistor M2 of reference voltage generating circuit 100 and has about the same threshold voltage $V_{TN}$. p-type MOS transistor M6 has the same constitution as p-type MOS transistor M3 of reference voltage generating circuit 100 and has about the same threshold voltage $V_TP$. Output terminal 108 is electrically connected to each memory cell plate and each bit line pair of the capacitive load circuit, for example, the memory array.

In the $\frac{1}{2}V_{DD}$ generating circuit with this structure the circuit is designed so that first reference voltage $\frac{1}{2}V_{DD}$ is obtained in node nP between p-type MOS transistor M3 and n-type MOS transistor M2 of reference voltage generating circuit 100. Thus, second reference voltage ($\frac{1}{2}V_{DD}+V_{TN}$) is obtained in the gate terminal of n-type MOS transistor M2, and third reference voltage ($\frac{1}{2}V_{DD}-V_{TP}$) is obtained at the gate terminal of p-type MOS transistor M2. N-type MOS transistor M2 and n-type MOS transistor M5, and p-type MOS transistor M3 and p-type MOS transistor M6 respectively constitute current mirror circuits, so that output voltage $\frac{1}{2}V_{DD}$, equal to first reference voltage $\frac{1}{2}V_{DD}$, is obtained in the node between n-type MOS transistor M5 and p-type MOS transistor M6, namely, at output terminal 108.

When the voltage level at output terminal 108 drops even slightly from $\frac{1}{2}V_{DD}$ due to fluctuation in the external circuit such as the load circuit, etc., voltage $V_{GS}$ between the gate and source exceeds threshold voltage $V_{TN}$N in n-type MOS transistor M5 of output circuit 102, and the transistor M5 turns on. Thus, the current flows into the load circuit from power source voltage terminal 104 through output terminal 108. The load circuit is capacitive, so that the potential of the load circuit rises with the current. When the output voltage level rises (is restored) to $\frac{1}{2}V_{DD}$, transistor M5 is turns off. Also, when the output voltage level rises even slightly from $\frac{1}{2}V_{DD}$, voltage $V_{GS}$ between the gate and the source exceeds threshold voltage $V_{TP}$ in p-type MOS transistor M6 of output circuit 102, and the transistor M6 turns on. Thus, current is led into ground terminal 106 from the load circuit via output terminal 108 and the potential of the load circuit drops. When the output voltage level drops (is restored) to $\frac{1}{2}V_{DD}$, transistor M6 turns off.

As noted above in the conventional $\frac{1}{2}V_{DD}$ generating circuit one of the transistors M5 and M6 operates in the linear region because voltage $V_{GS}$ between the gate and the source of output transistors M5 and M6 changes with respect to the fluctuation in the output voltage, and sources current to the output terminal 108 side from the power source voltage or supplies current to ground terminal 106 from the output terminal 108 side to correct the fluctuation in the output voltage. However, the current which flows by turning MOS transistors M5 and M6 on in the linear region is small; thus, a long time is necessary to restore the output voltage level to the normal value (near $\frac{1}{2}V_{DD}$).

On the other hand, the integration of a DRAM has improved exponentially to 1M, 4M, 16M, 64M, . . . and even the number of bit line pairs activated at once in the refresh cycle has increased to a few K, a few tens of K, . . . , and there is a trend for the capacitance of the load circuit connected to the $\frac{1}{2}V_{DD}$ generating circuit to increase further. The larger the capacitance of the load circuit, the greater the amount of current which must be supplied with respect to fluctuations in the output voltage. Also, the precharge time and the memory cycle are being decreased more as the integration of the DRAM is enhanced, so that greater speed is needed even in the voltage restoring operation. However, the conventional $\frac{1}{2}V_{DD}$ generating circuit has a limit to the capacity of the current supplied in capacity and a speed of feeding as noted above and it is not suited to the requirements of large capacity DRAMs of the super mb class.

It is an object of this invention to provide a $\frac{1}{2}V_{DD}$ generating circuit which greatly improves the capacity of the current supplied and the speed, and which can accommodate even large capacity DRAMs of the super mb class with sufficient margin.

SUMMARY OF THE INVENTION

In accordance with the invention, a voltage generating circuit is structured so as to have a power source voltage terminal which provides a prescribed power source voltage, and a reference voltage generating circuit which is connected to the power source voltage terminal and a ground terminal. The reference voltage generating circuit and generates a prescribed reference voltage corresponding to the power source voltage. The voltage generating circuit further includes an output terminal which is electrically connected to a load circuit, an output voltage detecting circuit which is connected to the reference voltage generating circuit and the output terminal, and which assumes a first state or a second state according to whether the difference between the reference voltage and the output voltage at the output terminal exceeds a prescribed value, and an output transistor which is connected to the output voltage detecting circuit, the output terminal, and the power source voltage terminal or the ground terminal, and supplies current to the ground terminal from the output terminal or to the output terminal from the power source voltage terminal by conducting in more or less the saturation region according to the state of the output voltage detecting circuit. Thus, a voltage generating circuit which supplies a prescribed voltage with respect to a capacitive load circuit is provided.

In a specific aspect of the invention, the voltage generating circuit may be $\frac{1}{2}V_{DD}$ generating circuit which supplies approximately ½ of the voltage (½ $V_{DD}$) of power source voltage ($V_{DD}$) with respect to a capacitive load circuit.

In a second embodiment of a $\frac{1}{2}V_{DD}$ generating circuit in accordance with the invention, a power source voltage terminal which provides a power source voltage is associated with a reference voltage generating circuit which is connected to the power source voltage terminal and a ground terminal, and generates a prescribed reference voltage corresponding to the power source voltage. The second $\frac{1}{2}V_{DD}$ generating circuit further includes an output terminal which is electrically connected to a load circuit, an output voltage detecting circuit which is connected to the reference voltage generating circuit and the output terminal, and assumes the first state or the second state according to whether the difference between the reference voltage and the output voltage on the output terminal exceeds a prescribed value or not, a first output transistor which is connected to the output voltage detecting circuit, the output terminal, and the power source voltage terminal or the ground terminal, and supplies current to the ground terminal from the output terminal or to the output terminal from the power source voltage terminal by operating in more or less the saturation region according to the state of the output voltage detecting circuit, and a second output transistor which is connected to the reference voltage generating circuit, the output terminal, and the power source voltage terminal or the ground terminal, and supplies current to the ground terminal from the output terminal or to the output terminal from the power source voltage terminal by operating in more or less the linear region according to the difference between the reference voltage and the output voltage on the output terminal. This second embodiment of a in a $\frac{1}{2}V_{DD}$ generating circuit supplies approximately ½ of the voltage ($\frac{1}{2}V_{DD}$) of the power source voltage ($V_{DD}$) with respect to a capacitive load circuit.

In the voltage generating circuit or $\frac{1}{2}V_{DD}$ generating circuit of the present invention, the state of the output voltage detecting circuit changes from, for example, the first state to the second state when the output voltage on the output terminal electrically connected to the load circuit deviates from a prescribed voltage level range. Then, the output transistor operates more or less in the saturated area in response to the state change in the output voltage detecting circuit. Thus, a large amount of current is supplied to the ground terminal from the output terminal side at an appropriate voltage or a large amount of current flows into the output terminal side at an appropriate voltage from the power source voltage terminal via the output transistor which operated near the saturated area. The load circuit has capacitance, so that the voltage fluctuation is quickly compensated for by supplying a large amount of current by the output transistor, and the output voltage is restored to the normal level within a short time.

Figure 1:
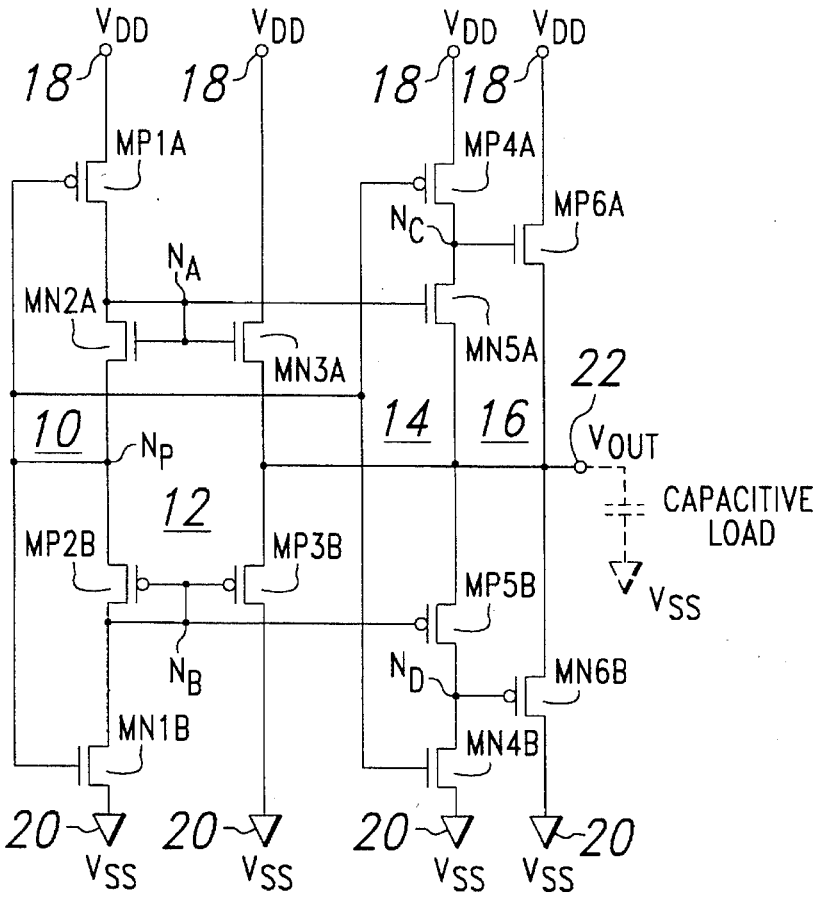
FIG. 1 is a circuit diagram of a $\frac{1}{2}V_{DD}$ generating circuit according to one embodiment of said invention.

Reference numerals and symbols as shown in the drawings:

10 . . . reference voltage generating circuit, 12 . . . analog output circuit, 14 . . . output voltage detecting circuit, 16 . .

. digital output circuit, 18 . . . power source voltage terminal, 20 . . . ground terminal, MP6A . . . p-type MOS transistor (first output transistor), MN6B . . . n-type MOS transistor (first output transistor), MN3A . . . n-type MOS transistor (second output transistor), MP3B . . . p-type MOS transistor (second output transistor).

DESCRIPTION OF THE PREFERRED EMBODIMENTS

FIG. 1 shows a $\frac{1}{2}V_{DD}$ generating circuit according to an embodiment of the invention. This $\frac{1}{2}V_{DD}$ generating circuit is comprises reference voltage generating circuit 10 which includes four MOS transistors MP1A, MN1B, MN2A, and MP2B, analog output circuit 12 provided by a pair of MOS transistors MN3A and MP3B (second output transistors), output voltage detecting circuit 14 composed of four MOS transistors MP4A, MN5A, MP5B, and MN4B, and digital circuit 16 composed of one pair of MOS transistors MP6A and MN6B (first output transistors).

Figure 5:
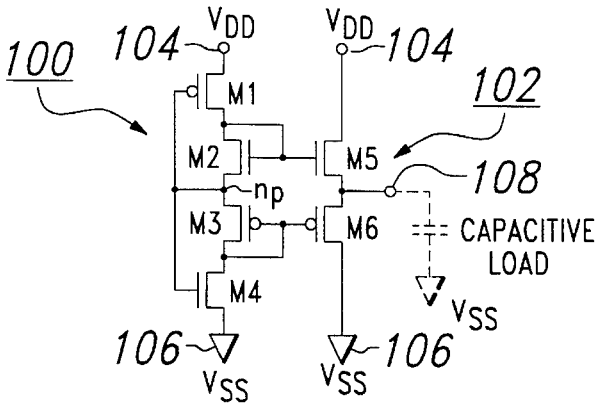
FIG. 5 is a circuit diagram showing a conventional $\frac{1}{2}V_{DD}$ generating circuit.

Reference voltage generating circuit 10 and analog output circuit 12 are circuits which are common to the conventional technology (reference voltage generating circuit 100 and output circuit 102 in FIG. 5).

Namely, in reference voltage generating circuit 10, the power source terminal of p-type MOS transistor MP1A is connected to power source voltage terminal 18 which provides power source voltage $V_{DD}$, and the power source terminal 20 of n-type MOS transistor MN1B is connected to ground terminal 20 which provides ground potential $V_{SS}$. The drain terminal and gate terminal of n-type MOS transistor MN2A are connected to the drain terminal of p-type MOS transistor MP1A, and the drain terminal and the gate terminal of p-type MOS transistor MP2B are connected to the drain terminal of n-type MOS transistor MN1B. The gate terminal of p-type MOS transistor MP1A, the gate terminal of n-type MOS transistor MN1B, the source terminal of n-type MOS transistor MN2A, and the source terminal of p-type MOS transistor MP2B are connected.

Also, in analog output circuit 12, the drain terminal of n-type MOS transistor MN3A is connected to power voltage terminal 18, and the drain terminal of p-type MOS transistor MP3B is connected to ground terminal 20. The source terminal of n-type MOS transistor MN3A and the source terminal of p-type MOS transistor MP3B are connected, and are also connected to output terminal 22. The gate terminal of n-type MOS transistor MN3A is connected to the source terminal of p-type MOS transistor MP1A and the gate terminal of n-type MOS transistor MN2A. The gate terminal of p-type MOS transistor MP3B is connected to the drain terminal of n-type MOS transistor MN1B and the gate terminal of p-type MOS transistor MP2B. n-type MOS transistor MN3A and p-type MOS transistor MP3B have more or less the same constitution as n-type MOS transistor MN2A and p-type MOS transistor MP2B of reference voltage generating circuit 10, and have threshold voltages $V_{TN3}$ and $V_{TP3}$ which are at about the same potential as threshold voltages $V_{TN}$ and $V_{TP}$ of said transistors MN2A and MP2B.

Therefore, as in the conventional technology, in reference voltage generating circuit 10, the circuit design is such that first reference voltage $\frac{1}{2}V_{DD}$ is obtained at node NP between p-type MOS transistor MP2B and n-type MOS transistor MN2A. Thus, second reference voltage ($\frac{1}{2}V_{DD}$+VTN) is obtained at the drain terminal (node NA) and the gate terminal of n-type MOS transistor MN2A, and third reference voltage ($\frac{1}{2}V_{DD}$−VTP) is obtained at the drain terminal (node NB) and the gate terminal of p-type MOS transistor MP2B. Also, n-type MOS transistor MN2A and n-type MOS transistor MN3A, and p-type MOS transistor MP2B and p-type MOS transistor MP3B respectively constitute current mirror circuits, so that output voltage VOUT which is about the same as first reference voltage $\frac{1}{2}V_{DD}$ is obtained at the node between n-type MOS transistor MN3A and p-type MOS transistor MP3B, namely, at output terminal 22.

Output voltage detecting circuit 14 and digital output circuit 16 are newly installed circuits in this application example.

In output voltage generating circuit 14, the source terminal of p-type MOS transistor MP4A is connected to power voltage terminal 18, and the source terminal of n-type MOS transistor MN4B is connected to ground terminal 20. The drain terminal of n-type MOS transistor MN5A is connected to the drain terminal of p-type MOS transistor MP4A, and the drain terminal of p-type MOS transistor MP5B is connected to the drain terminal of n-type MOS transistor MN4B. The source terminal of n-type MOS transistor MN5A and the source terminal of p-type MOS transistor MP5B are connected together, and also connected to output terminal 22.

The respective gate terminals of p-type MOS transistor MP4A and n-type MOS transistor MN4B are connected to node NP of reference voltage generating circuit 10. The gate terminal of n-type MOS transistor MN5A is connected to the gate terminal (node NA) and the drain terminal of n-type MOS transistor MN2A in reference voltage generating circuit 10, and the gate terminal of p-type MOS transistor MP5B is connected to the gate terminal (node NB) and the drain terminal of p-type MOS transistor MP2B in reference voltage generating circuit 10.

Threshold voltages $V_{TN5}$ and $V_{TP5}$ of n-type MOS transistor MN5A and p-type MOS transistor MP5B are selected to be values slightly larger than threshold voltages $V_{TN3}$ and $V_{TP3}$ of n-type MOS transistor MN3A and p-type MOS transistor MP3B in analog output circuit 12. For example, 0.9 V is selected for $V_{TN5}$ and $V_{TP5}$ when $V_{TN3}$ and $V_{TP3}$ are 0.8 V.

In digital output circuit 16, the source terminal of p-type MOS transistor MP6A is connected to power voltage terminal 18, and the source terminal of n-type MOS transistor MN6B is connected to ground terminal 20. The drain terminal of p-type MOS transistor MP6A and the drain terminal of n-type MOS transistor MN6B are connected together, and also connected to output terminal (22). The gate terminal of p-type MOS transistor MP6A is connected to the drain terminal (node NC) of n-type MOS transistor MN5A and the drain terminal of p-type MOS transistor MP4A in output voltage detecting circuit 14, and the gate terminal of n-type MOS transistor MN6B is connected to the drain terminal (node ND) of p-type MOS transistor MP5B and the drain terminal of n-type MOS transistor MN4B in output voltage detecting circuit 14.

Output terminal 22 is electrically connected to each memory cell plate and each bit line pair of a capacitive load circuit, for example, the memory array circuit of DRAM.

Next, the operation of a $\frac{1}{2}V_{DD}$ generating circuit in the embodiment will be explained. As one example, the case when source voltage $V_{DD}$ is 3.3 V, the reference value of output voltage ($\frac{1}{2}V_{DD}$) is set to 1.65 V, and the normal or allowable range of output voltage ($\frac{1}{2}V_{DD}$) is set to (1.65±0.1) V will be explained.

In this case, the margin of output voltage ($\frac{1}{2}V_{DD}$) is ±0.1 V so that threshold voltages $V_{TN5}$ and $V_{TP5}$ of n-type MOS transistor MN5A and p-type MOS transistor MP5B in output voltage detecting circuit 14 are selected to be values larger by just the amount of the margin (0.1 V) with respect to threshold voltages $V_{TN3}$ and $V_{TP3}$ of n-type MOS transistor MN3A and p-type MOS transistor MP3B in analog output circuit 12. Therefore, 1.0 V is selected for $V_{TN5}$ and $V_{TP5}$ when 0.9 is selected for $V_{TN}$N3 and $V_{TN}$P3.

In reference voltage generating circuit 10, 1.65 V is always obtained reliably as the first reference voltage at node NP, 2.55 (1.65+0.9) V is always obtained reliably as the second reference voltage at node NA, and 0.75 (1.65–0.9) V is always obtained reliably as the third reference voltage at node NB. Second reference voltage (2.55 V) obtained at node NA is provided to the gate terminal of n-type MOS transistor MN3A in analog output circuit 12 in addition to the gate terminal of n-type MOS transistor MN5A in output voltage detecting circuit 14. The third reference voltage (0.75 V) obtained in node NB is provided to the gate terminal of p-type MOS transistor MP3B in analog output circuit 12 along with providing to the gate terminal of p-type MOS transistor MP5B in output voltage detecting circuit 14.

In analog output circuit 12, when output voltage VOUT on output terminal 22 deviates even slightly from $\frac{1}{2}V_{DD}$ (1.65 V), either n-type MOS transistor MN3A or p-type MOS transistor MP3B turns on in the linear region. Namely, when output voltage $V_{OUT}$ becomes slightly lower than $\frac{1}{2}V_{DD}$ (1.65 V), voltage $V_{GS}$ between the gate and the source of n-type MOS transistor MN3A exceeds threshold voltage $V_{TN3}$, so that said transistor MN3A turns on at said limit, namely, in the linear region, current flows into the output terminal 22 side from power terminal 18, and the potential of the load circuit, namely, the level of output voltage $V_{OUT}$ is raised. Also, when output voltage $V_{OUT}$ becomes slightly higher than $\frac{1}{2}V_{DD}$ (1.65 V), voltage $V_{GS}$ between the gate and source of p-type MOS transistor MP3B exceeds threshold voltage $V_{TP3}$, so that said transistor MP3B turns on at said limit, namely, in the linear region, current is supplied to ground terminal 20 from the output terminal 22 side, and the potential of the load circuit, namely, the level of output voltage $V_{OUT}$, drops.

The capacity of one current supplied or lead in with this type of analog circuit 12 is low, so that if the fluctuation of the output voltage $V_{OUT}$ is large, particularly when the capacity of the load circuit is large, it is not possible to restore the output voltage independently in a short time. However in the $\frac{1}{2}V_{DD}$ generating circuit of said application example, the insufficiency in the capacity of analog output circuit 12 is compensated for by digital output circuit 16 and output voltage detecting circuit 14 as will be discussed below.

When output voltage $V_{OUT}$ is at the normal level, namely, when it is within the margin Δv (±0.1 V) from reference value $\frac{1}{2}V_{DD}$ (1.65 V), voltage $V_{GS}$ between the gate and source of p-type MOS transistor MP5B and n-type MOS transistor MN5A is smaller than threshold voltages $V_{TN5}$ and $V_{TP5}$ (1.0 V) in output voltage detecting circuit 14, so that both transistors MN5A and MP5B are turned off. On the other hand, p-type MOS transistor MP4A and n-type MOS transistor MN4B receive first reference voltage $\frac{1}{2}V_{DD}$ (1.65 V) from reference voltage generating circuit 10 at the respective gate terminals and are turned on. Therefore, the gate terminals of p-type MOS transistor MP6A in digital output circuit 16 or node NC is precharged to a potential near power source voltage $V_{DD}$ via p-type MOS transistor MP4A, and p-type MOS transistor MP6A is turned off. Also, the gate terminal of n-type MOS transistor MN6B in digital output circuit 16 or node ND is precharged to a potential near ground potential $V_{SS}$ via n-type MOS transistor MN4B, and n-type MOS transistor MN6B is turned off.

Figure 2:
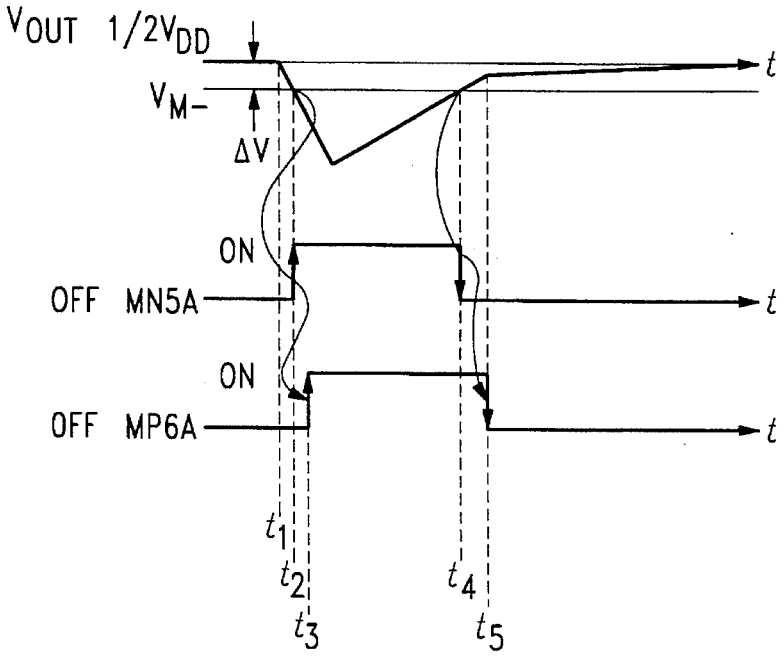
FIG. 2 is a waveform diagram of each part to explain the operation when the output voltage drops in the $\frac{1}{2}V_{DD}$ generating circuit of the embodiment shown in FIG. 1.

Here, the assumption will be made that output voltage $V_{OUT}$ fluctuates at time $t_1$ and suddenly drops from reference value $\frac{1}{2}V_{DD}$ (1.65 V) as shown in FIG. 2. In this case, voltage $V_{GS}$ between the gate and source of n-type MOS transistor MN5A in output voltage detecting circuit 14 exceeds threshold value $V_{TN5}$ (1.0 V) at time $t_2$ when output voltage $V_{OUT}$ goes lower than the lower limit allowable voltage level VM– (1.55 V), and transistor MN5A is turned on.

Then, the potential of node NC, namely, the potential of the gate terminal for p-type MOS transistor MP6A is pulled to the level of output voltage $V_{OUT}$ via the transistor MN5A which was turned on. Thus, voltage $V_{GS}$ between the gate and source of p-type MOS transistor MP6A becomes more than ($\frac{1}{2}V_{DD}$+ΔV) (in this example, over 1.75 V), and p-type MOS transistor MP6A is turned on in the saturated area more or less perfectly digitally or by switching at time $t_3$. With a large current flow to the output terminal 22 side, namely, the load circuit side, at an appropriate from power terminal 18 via p-type MOS transistor MP64 which was turned on in said saturated area, the reduction in output voltage $V_{OUT}$ is stopped in a short time and output voltage $V_{OUT}$ reverses and rises (recovers). The rise (restoration) of output voltage $V_{OUT}$ is executed quickly and when the lower limit of the allowable voltage level VM– (1.55 V) is exceeded at time $t_4$, n-type MOS transistor MN5A of output voltage detecting circuit 14 is turned off.

When n-type MOS transistor MN5A is turned off, node NC is charged again via p-type MOS transistor MP4A, the potential of node NC, namely, the potential of the gate terminal in p-type MOS transistor MP6A rises gradually, p-type MOS transistor MP6A is turned off at time $t_5$, and the operation of digital output circuit 16 ends.

After the operation of digital output circuit 16 ends (after time $t_5$), output voltage $V_{OUT}$ on output terminal 22 slowly rises towards reference value $\frac{1}{2}V_{DD}$ by supplying a small amount of current from analog circuit 12. Output voltage $V_{OUT}$ has already been restored to within the allowable range (normal level) by the function of digital output circuit 16, so that there is no risk of any obstacles even when the necessary operation is executed with the load circuit during this period.

In this way, in the $\frac{1}{2}V_{DD}$ generating circuit of the embodiment by n-type MOS transistor MN5A of output voltage detecting circuit 14 turning on when output voltage $V_{OUT}$ fluctuates and goes lower than the lower limit of the allowable voltage level VM– (1.55 V), and p-type MOS transistor MP6A of digital output circuit 16 turning on in the saturated area more or less perfectly digitally or by switching in response, a greater amount of current flows to the load circuit at the output terminal 22 side with an approprial voltage from power source voltage terminal 18 via the p-type MOS transistor MP6A. Consequently, even if the reduction in output voltage $V_{OUT}$ is abrupt and large, and furthermore, even if the capacitance of the load circuit is large, the fluctuation in output voltage $V_{OUT}$ is stopped quickly and restored to the normal level within a short time.

Figure 3:
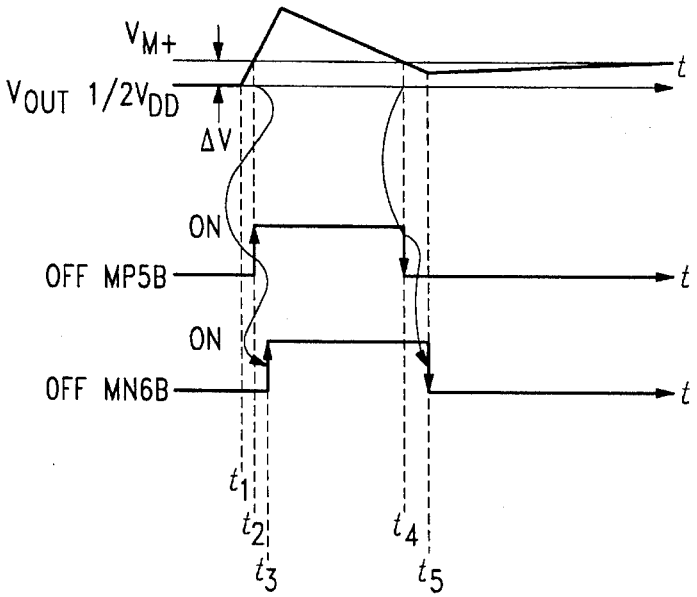
FIG. 3 is a waveform diagram of each part for explaining the operation when the output voltage rises in the $\frac{1}{2}V_{DD}$ generating circuit of the embodiment shown in FIG. 1.

Also, when output voltage $V_{OUT}$ fluctuates suddenly and exceeds the upper limit of the allowable voltage level VM+ (1.75 V) as shown in FIG. 3, since p-type MOS transistor MP5B of output voltage detecting circuit 14 turns on, and n-type MOS transistor MN6B of digital output circuit 16 turns on in the saturated area more or less perfectly digitally or by switching in response, a large amount of current is supplied at an appropriate force to ground terminal 20 from the load circuit on the output terminal 22 side via said n-type MOS transistor MN6B. Consequently, even if the rise in output voltage $V_{OUT}$ is abrupt and large, and furthermore, even if the capacitance of the load circuit is large, the fluctuation in output voltage $V_{OUT}$ is stopped quickly and restored to the normal level within a short time.

Figure 4:
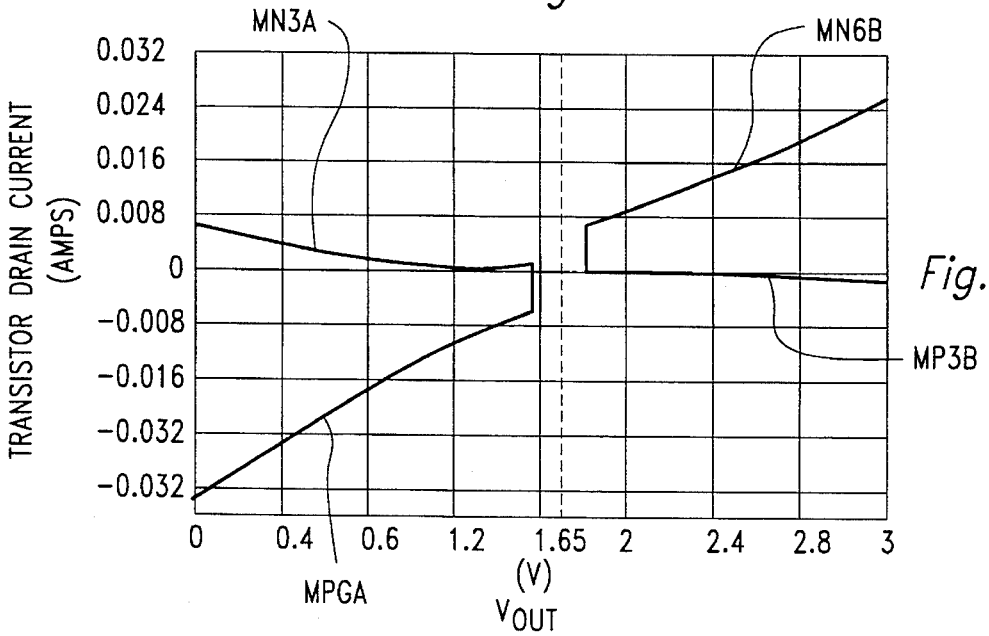
FIG. 4 is a graph showing a comparison between the capacity of the current supplied by the transistors in the analog output circuit and the digital output circuit in the $\frac{1}{2}V_{DD}$ generating circuit of the embodiment shown in FIG. 1.

FIG. 4 shows a comparison between the capacity of the current supplied or led in from MOS transistors MP6A and MN6B in digital output circuit 16 and the current supplied or led in from MOS transistors MN3A and MP3B in analog output circuit 12.

In FIG. 4, the horizontal axis indicates voltage $V_{OUT}$ of output terminal 22 and the vertical axis indicates the drain current of each transistor. Even from these characteristics, it is apparent that the capacity of the current supplied by MOS transistors MP6A and MN6B in digital output circuit 16 is much greater than that from MOS transistors MN3A and MP3B in analog output circuit 12. In the $\frac{1}{2}V_{DD}$ generating circuit of the embodiment which used this data, the capacity of the current supplied by transistors MP6A and MN3A is designed to be relatively greater than that of MP6A and MN3A by giving consideration to the fact that generally, there is more often a tendency for the output voltage $V_{OUT}$ to drop than to rise.

In the embodiment, p-type MOS transistor MP4A and n-type MOS transistor MN4B were provided to output voltage detecting circuit 14 in order to respectively pre-charge the gate terminal of n-type MOS transistor MN6B and p-type MOS transistor MP6A in digital output circuit 16 but it is possible to replace the transistors MP4A and MN4B with resistance circuits, time constant circuits, or diode circuits. Also, it is possible to optionally set or adjust the operating range of digital output circuit 16 by selecting a suitable value for threshold voltages $V_{TN5}$ and $V_{TP}$5 of n-type MOS transistor MN5A and p-type MOS transistor MP5B in output voltage detecting circuit 14. Also, the circuit configuration of analog output circuit 12 is not limited to that of the embodiment, as various alterations and modifications are possible, and furthermore, it is possible to even omit analog output circuit 12 according to necessity.

Also, the embodiment is specifically concerned with a $\frac{1}{2}V_{DD}$ generating circuit which feeds approximately ½ of the voltage ($\frac{1}{2}V_{DD}$) of the power source voltage ($V_{DD}$) With respect to a capacitive load circuit. However, the invention is not limited to a $\frac{1}{2}V_{DD}$ generating circuit and can be applied to a voltage generating circuit which feeds an optional output voltage with respect to a capacitive load circuit.

As explained above, according to the voltage generating circuit or $\frac{1}{2}V_{DD}$ generating circuit of the invention, it is possible to stop the fluctuation in the output voltage quickly and to restore the voltage to a normal level within a short period of time, even if the fluctuation in the output voltage is large or the capacitance of the load circuit is large since the current is made to flow to the output terminal from the power source voltage terminal or to the ground terminal from the output terminal by the state of the output voltage detecting circuit changing when the output voltage on the output terminal electrically connected to the capacitive load circuit fluctuates from the prescribed level range, and the output transistor is made to operate near the saturated area by responding to the state change in the output voltage detecting circuit. Consequently, it is possible to accommodate even large capacity DRAMs with sufficient margin.

We claim:

1. A voltage supply circuit for a capacitive load, comprising the following coupled in parallel between a supply voltage and a ground:

a reference circuit for generating a first reference voltage half of the supply voltage, a second reference voltage equal to the first reference voltage plus a predetermined analog threshold voltage, and a third reference voltage equal to the first reference voltage minus the analog threshold voltage;

an analog push-pull amplifier circuit having first and second reference inputs respectively coupled to the reference circuit to receive the second and third reference voltages, and a push-pull output terminal for coupling to the capacitive load;

a digital detecting circuit having first and second detecting inputs respectively coupled to the reference circuit to receive the second and third reference voltages and a third detecting input coupled to the push-pull output terminal, a normally OFF first control output which generates a first ON control signal when the second reference voltage minus the push-pull output voltage exceeds a predetermined switching threshold voltage larger than the analog threshold voltage, and a normally OFF second control output which generates a second ON control signal when the push-pull output voltage minus the third reference voltage exceeds the predetermined switching threshold voltage; and a digital switch having first and second digital inputs respectively coupled and responsive to the digital detecting circuit to receive the first and second ON control signals, for coupling the push-pull output terminal and its capacitive load (i) to the supply voltage when the first ON control signal is present and (ii) to the ground when the second ON control signal is present.

* * * * *